US006657059B2

(12) United States Patent
Hiskey et al.

(10) Patent No.: US 6,657,059 B2
(45) Date of Patent: Dec. 2, 2003

(54) 3,6BIS(1H-1,2,3,4-TETRAZOL-5-YLAMINO)-1,2,4,5-TETRAZINE OR SALT THEREOF

(75) Inventors: Michael A. Hiskey, Los Alamos, NM (US); David E. Chavez, Ranchos de Taos, NM (US); Darren Naud, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/213,545

(22) Filed: Aug. 6, 2002

(65) Prior Publication Data

US 2003/0168140 A1 Sep. 11, 2003

Related U.S. Application Data

(62) Division of application No. 09/561,309, filed on Apr. 28, 2000, now Pat. No. 6,458,227.

(51) Int. Cl.[7] ..... C07D 257/08
(52) U.S. Cl. ..... 544/179; 149/36
(58) Field of Search ..... 544/179; 149/36

(56) References Cited

U.S. PATENT DOCUMENTS 2,369,371 A * 2/1945 Seiberlich ..... 544/179
3,151,111 A * 9/1964 Remanick ..... 544/179
3,244,702 A * 4/1966 Marcus ..... 544/179
3,797,238 A * 3/1974 Iwanciow et al. ..... 149/36
3,904,614 A * 9/1975 Lang et al. ..... 544/179
3,940,298 A * 2/1976 Beckert et al. ..... 149/92
4,142,029 A * 2/1979 Illy ..... 521/95
4,369,079 A * 1/1983 Shaw ..... 149/2
4,601,846 A * 7/1986 Demus et al. ..... 544/179
5,274,091 A * 12/1993 Coburn et al. ..... 544/179
5,281,706 A * 1/1994 Coburn et al. ..... 544/179
5,516,377 A * 5/1996 Highsmith et al. ..... 149/36
5,587,370 A * 12/1996 Hajimichael et al. ..... 544/179
5,917,146 A * 6/1999 Hiskey et al. ..... 149/36
6,214,139 B1 * 4/2001 Hiskey et al. ..... 149/36
6,312,537 B1 * 11/2001 Hiskey et al. ..... 149/36
6,342,589 B1 * 1/2002 Hiskey et al. ..... 534/567
6,458,227 B1 * 10/2002 Hiskey et al. ..... 544/179

* cited by examiner

*Primary Examiner*—Edward A. Miller
(74) *Attorney, Agent, or Firm*—Bruce H. Cottrell

(57) ABSTRACT

The compound 3,6-bis(1H-1,2,3,4-tetrazol-5-ylamino)-1,2,4,5-tetrazine and its salts are provided together with a propellant composition including an oxidizer, a binder and 3,6-bis(1H-1,2,3,4-tetrazol-5-ylamino)-1,2,4,5-tetrazine or its salts.

2 Claims, 1 Drawing Sheet

3,6BIS(1H-1,2,3,4-TETRAZOL-5-YLAMINO)-1,2,4,5-TETRAZINE OR SALT THEREOF

This application is a divisional of Ser. 09/561,309 filed Apr. 28, 2000, now U.S. Pat. No. 6,458,227, by Hiskey et al.

FIELD OF THE INVENTION

The present invention relates to a tetrazine based energetic material and more particularly to 3,6-bis(1H-1,2,3,4-tetrazol-5-ylamino)-1,2,4,5-tetrazine and its salts, e.g., the di-ammonium, di-hydroxylammonium, or di-hydrazinium salt. Additionally, the present invention relates to composite propellants including such a tetrazine based energetic material. This invention was made with government support under a contract with the Department of Energy (Contract No. W-7405-ENG-36).

BACKGROUND OF THE INVENTION

Solid propellants are used extensively in the aerospace industry. Solid propellants have developed as the preferred method of powering most missiles and rockets for military, commercial, and space applications. Solid rocket motor propellants have become widely accepted because of the fact that they are relatively simple to formulate and use, and they have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, ballistic catalysts, and other similar materials which aid in the processing, curing, and burning properties of the propellant. A significant body of technology has developed related solely to the processing and curing of solid propellants, and this technology is well known to those skilled in the art.

One type of propellant that is widely used incorporates ammonium perchlorate (AP) as the oxidizer. The ammonium perchlorate oxidizer may then, for example, be incorporated into a propellant which is bound together by a hydroxy-terminated polybutadiene (HTPB) binder. Such binders are widely used and commercially available. It has been found that such propellant compositions provide ease of manufacture, relative ease of handling, good performance characteristics; and are at the same time economical and reliable. In essence it can be said that ammonium perchlorate composite propellants have been the backbone of the solid propulsion industry for approximately the past 40 years.

In certain composite propellants, the propellant is "metallized." That is, the propellant includes from about 5% to about 25% by weight metal. The metal may be aluminum, magnesium or other suitable metal. Generally, aluminum is the metal of choice. The particle size of the metal is known to affect the plateau burning of the propellant. In most applications, metal particles in the range of 5 $\mu$m to 80 $\mu$m are preferred.

Despite the success of conventional composite propellants, research into new energetic materials has continued. The development of additional energetic materials can allow for a greater variety of propellant formulations with varying properties.

An object of the present invention is to provide new energetic materials such as 3,6-bis(1H-1,2,3,4-tetrazol-5-ylamino)-1,2,4,5-tetrazine (BTATZ) and its salts.

Another object of the present invention is to provide a process of preparing such energetic materials.

Still another object of the present invention is to provide composite propellants including the energetic material 3,6-bis(1H-1,2,3,4-tetrazol-5-ylamino)- 1,2,4,5-tetrazine (BTATz).

SUMMARY OF THE INVENTION

To achieve the foregoing and other objects, and in accordance with the purposes of the present invention, as embodied and broadly described herein, the present invention provides for the compound 3,6-bis(1H-1,2,3,4-tetrazol-5-ylamino)-1,2,4,5-tetrazine.

The present invention further provides for the compounds, 3,6-bis(1H-1,2,3,4-tetrazol-5-ylamino)-1,2,4,5-tetrazine2$NH_4^+$, 3,6-bis(1H-1,2,3,4-tetrazol-5-ylamino)1,2,4,5-tetrazine2$NH_2NH_3^+$ and 3,6-bis(1H-1,2,3,4-tetrazol-5-ylamino)-1,2,4,5-tetrazine,2$HONH_3^+$.

The present invention further provides a propellant composition including an oxidizer, a binder and 3,6-bis(1H-1,2,3,4-tetrazol-5-ylamino)-1 ,2,4,5-tetrazine.

DETAILED DESCRIPTION

Figure 1:
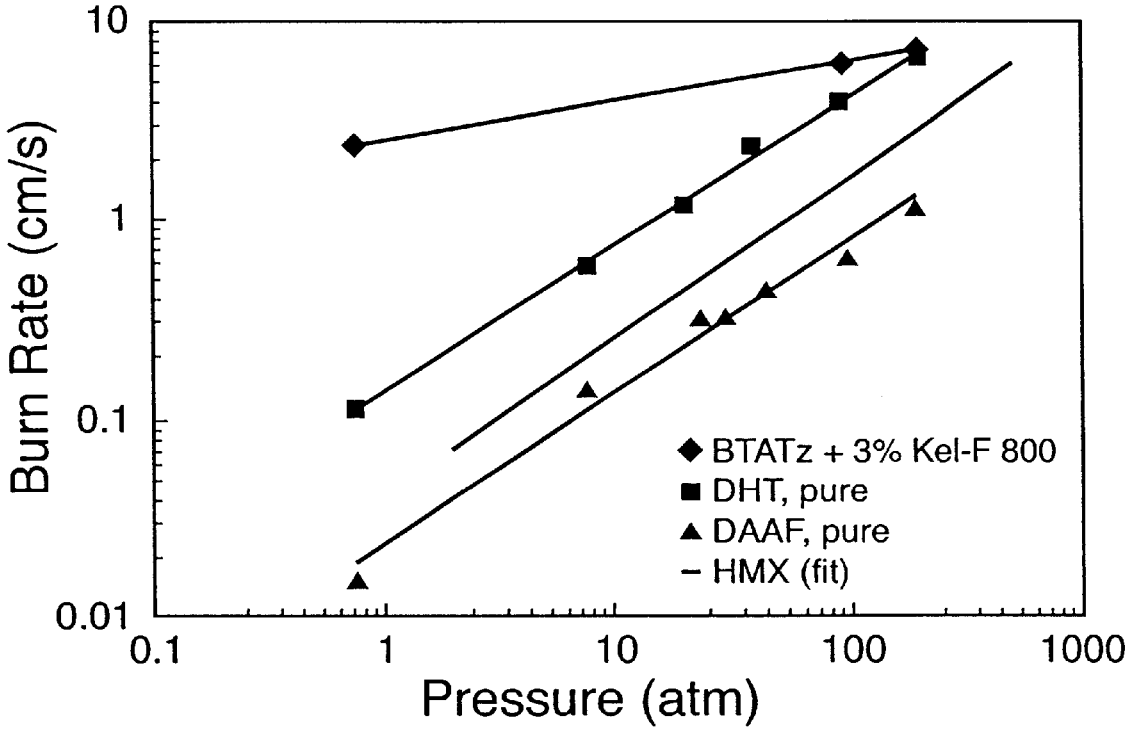
FIG. 1 shows a graph of burn rate versus pressure for one compound of the present invention and related prior art compounds.

The present invention is concerned with tetrazine based energetic materials. In particular, the present invention is directed to 3,6-bis(1H-1,2,3,4-tetrazol-5-ylamino)1,2,4,5-tetrazine (BTATz) and its salts, e.g., di-ammonium, di-hydroxylammonium, and di-hydrazinium salts. Further, the present invention is directed to propellant compositions including an oxidizer, a binder and 3,6-bis(1H-1,2,3,4-tetrazol-5-ylamino)-1,2,4,5-tetrazine.

Suitable oxidizers for use with the BTATz and its salts can includealkali perchlorates, alkali chlorates, alkali nitrates, alkali di-nitramides, alkaline earth perchlorates, alkaline earth chlorates, alkaline earth nitrates, alkaline earth di-nitramides, ammonium perchlorate, ammonium chlorate, ammonium nitrate, ammonium dinitramide, hydraziunium perchlorate, hydraziunium chlorate, hydraziunium nitrate, and hydraziunium di-nitramide. Preferably, the oxidizer is ammonium perchlorate, ammonium di-nitramide and potassium perchlorate. More preferably, the oxidizer is ammonium perchlorate.

BTATz is a very energetic fuel containing no oxygen in its structure. It has been found that a pressed pellet of 0.5-inch diameter does not detonate. Thus, the material has a large failure diameter and thus has desirable properties for a propellant material.

Failure diameter is the minimum diameter of material needed to propogate a detonation wave.

BTATz has a high burn rate as shown in FIG. 1 wherein the burn rate of BTATz (with 3 percent by volume of Kel-F 800 resin as a binder) is shown and compared with the burn rate of commonly known materials such as 3,6-dihydrazino-s-tetrazine (DHT), 3,3'-diannino-4,4'-azoxyfurazan (DAAF), and HMX. Besides a high burn rate, the plot of burn rate for BTATz has an unexpectedly low slope thereby providing BTATz with a combination of properties that can allow a rocket motor designer leeway.

Thus, the present invention is also related to a solid rocket motor propellant. The propellant compositions include a binder, a major amount of ammonium perchlorate, and 3,6-bis(1H-1,2,3,4-tetrazol-5-ylamino)-1,2,4,5-tetrazine.

The ammonium perchlorate can have one or more distinct particle sizes. For example, there can be small particles having particle sizes in the range of from about 2 μm to about 75 μm, plus larger particles having particle sizes in the range of from about 90 μm to about 400 μm.

The crosslinker used to cure the propellant formulation is also of critical importance. Generally, isocyanate crosslinkers are used when HTPB binders are employed. Examples of such crosslinkers include tetramethylxylylene diisocyanante (TMXDI), isophorone diisocyanate (IPDI), and dimeryl diisocyanate (DDI). Generally, the crosslinker comprises from about 0.5 percent by weight to about 2.0 percent by weight of the propellant composition. Other crosslinkers are well known to those skilled in the art and may be used.

Other materials may also be added to the propellant formulations. For example, the propellant may comprise from about 1% to about 3% by weight plasticizer, such as dioctyladipate (DOA). Other plasticizers are well known to those skilled in the art and may be used in place of DOA.

It is presently preferred that the binder be a conventional non-energetic binder such as a hydroxy-terminated polybutadiene. Other binders such as polyesters, polyethers, and PBAN may also be employed in the present invention. Such materials are readily available on the commercial market. For example one such binder is R45M hydroxy-terminated polybutadiene binder, manufactured by Atochem. The binder generally comprises from about 7% to about 12% by weight of the propellant composition.

As a propellant material, BTATz may be used as a substitute for aluminum metal in prior formulations. A typical composite propellant formulation including BTATz can include from about 5 percent by weight to 20 percent by weight of hydroxy-terminated polybutadiene binder (HTPB), curative (e.g., IPDI), and plasticizer (e.g., DOA) in combination, preferably from about 11 percent by weight to about 17 percent by weight of HTPB, IPDI, and DOA in combination, from about 55 percent by weight to about 80 percent by weight of ammonium perchlorate (AP), preferably from about 65 percent by weight to about 75 percent by weight AP, and from about 10 percent by weight to about 22 percent by weight of BTATz, preferably from about 14 percent by weight to about 18 percent by weight BTATz.

The present invention is more particularly described in the following examples which are intended as illustrative only, since numerous modifications and variations will be apparent to those skilled in the art.

All starting materials were obtained from commercial sources or prepared from the referenced literature. All NMR spectra were obtained on a JEOL GSX-270 spectrometer, and chemical shifts are reported relative to internal tetramethylsilane. Melting points were determined at 2° C./min with a Mettler FPI apparatus and are corrected or by Differential Scanning Calorimetry (DSC) at 2° C. per minute. IR spectra were obtained on a Bio-Rad FFS40 FTIR spectrometer.

EXAMPLE 1

3,6-Bis(1H-1,2,3,4-tetrazol-5-ylamino)-1,2,4,5-tetrazine (BTATz). To a solution of 3,6-dichloro-1,2,4,5-tetrazine (1.51 g, 10 mmol) in acetonitrile (70 ml) was added the sodium salt of 5-amino-1H-tetrazole (2.14 g, 10 mmol). The mixture was refluxed for 24 hours then allowed to cool to room temperature. The suspension was centrifuged until the supernatant liquid was clear. The liquid was decanted and the brown solid washed successively with acetonitrile and water. With each wash the solid was separated from the solvent by centrifugation followed by decantation. The isolated crude yield was 1.5 g (60%), this material was recrystallized from DMSO/methanol yielding an orange brown powder mp 264° C. dec; $^{1}$H NMR (deuteriomethylsulfoxide) ∂ 12.5(b,r s,4H); $^{13}$C NMR (deuteriomethylsulfoxide) ∂ 151.74, 158.25; IR (KBr) 3421, 3000, 1615, 1436, 1127 cm$^{-1}$.

A gas pycnometer density of 1.76 g/cm$^3$ was also determined and a drop height of 195 cm was measured (Type 12, HMX=24–27 cm).

EXAMPLE 2

BTATz (2.11 g, 8.51 mmol) was slowly heated in 40 ml of dimethyl sulfoxide (DMSO) with continuous stirring until fully dissolved. This solution was added in one portion to an aqueous solution of hydrazine hydrate (1.1 g, 22 mmol) and 30 ml of water and stirred for several minutes. To the resulting dark solution was added 30 ml of isopropyl alcohol to initiate precipitation. The pink-colored salt was filtered, washed with copious amounts of isopropyl alcohol and dried to yield the di-hydrazinium salt of BTATz (2.53 g, 95% yield).

EXAMPLE 3

BTATz (2.09 g, 8.43 mmol) was slowly heated in 40 ml of DMSO with continuous stirring until fully dissolved. This solution was added in one portion to an aqueous solution containing two equivalents of hydroxylamine and 20 ml of water and stirred for several minutes. The solution was cooled and 40 ml of isopropyl alcohol was added to initiate precipitation. The red-colored salt was filtered, washed with copious amounts of isopropyl alcohol and dried to yield the di-hydroxylammonium salt of BTATz (2.42 g, 91% yield).

EXAMPLE 4

BTATz (2.04 g, 8.23 mmol) was slowly heated in 40 ml of DMSO with continuous stirring until fully dissolved. This solution was added in one portion to an aqueous solution containing 2.5 equivalents of ammonia and 20 ml of water and stirred for several minutes. The solution was cooled and 100 ml of isopropyl alcohol was added to initiate precipitation. The red-colored salt was filtered, washed with copious amounts of isopropyl alcohol and dried to yield the diammonium salt of BTATz (2.07 g, 89% yield).

EXAMPLE 5

Dry sulfolane (500 ml), anhydrous 5-amino-1H-tetrazole (39.4 g, 0.463 mole) and 3,6-bis(3,5-dimethylpyrazol-1-yl)-s-tetrazine (50.0 g, 0.185 mol) were mixed in a 1 liter flask that was continuously purged with a slow stream of dry nitrogen gas. The reaction mixture was initially a thick, orange slurry, but slowly converted into a dark solution when it was heated slowly to 135° C. The heating was maintained at 135° C. with a temperature controller. Within several hours, a precipitate began to form. After 18 hours of heating, the dark slurry was cooled to 50° C. and 50 ml of dimethylformamide (DMF) was added to prevent the sulfolane from freezing. The precipitate was filtered, washed with a large amount of DMF and oven-dried for several days at 100° C. to give 40.2 g of crude product (88% yield). The crude material was triturated with 500 ml of boiling DMF over 18 hours, cooled, filtered and washed with additional DMF. Drying in a vacuum oven for three days at 100° C. yielded 20.3 g of pure BTATz (44% yield).

EXAMPLE 6

BTATz is incorporated into a composite propellant as follows. A composite propellant is prepared including about 70 percent by weight of ammonium perchlorate, about 14 percent by weight of HTPB, EPDI, DOA and about 16 percent by weight of BTATz as a substitute for aluminum metal, a more typical propellant ingredient. The $I_{sp}$ of the aluminized system is 264 s. The $I_{sp}$ for the propellant system including the BTATz is calculated as 232 s or 88 percent of the performance of the aluminized system. BTATz as a monopropellant has an $I_{sp}$ of 215 s.

EXAMPLE 7

A reaction bomb capable of handling pressures of up to 3000 psi was used for this study. Pellet-sized samples (1-cm diameter) of selected pure or formulated high-nitrogen materials were prepared and mounted on a burn stage. The tested materials included: (1) a composition including BTATz and 3 percent by volume of Kel-F800 resin (a chlorotrifluoroethylene/vinylidene fluoride copolymer, available from 3M Company); (2) 3,3'-diamino-4,4'-azoxyfurazan (DAAF); and (3) 3,6-dihydrazino-s-tetrazine (DHT). The stage was contained in the pressure bomb that was charged with inert gas at specified pressures before each burn run. Standard techniques were implemented to measure the burn rate. Specifically, these were solder "break" wires and optical imaging with video or high-speed photography of the burn front. The measured burn rate data are shown in FIG. 1. For comparison, a fitted burn rate profile of HMX is included in FIG. 1. was found that both DHT and BTATz burn faster than HMX and DAAF, though neither DHT nor BTATz contains oxygen within the molecular framework. With DHT and BTATz, it was found that their flame fronts were barely perceptible to the human eye. Burning DHT had the appearance of a solid progressively transforming to slightly smoky gas. It was found that BTATz burned more vigorously than DHT but produced more smoke, which is attributed to its complete lack of oxygen. The pressure exponents of BTATz, DHT, DAAF and HMX were calculated as 0.20, 0.75, 0.77 and 0.87 respectively. BTATz had both a high-burn rate and low pressure exponent making it a suitable candidate as a high-performance propellant fuel.

Although the present invention has been described with reference to specific details, it is not intended that such details should be regarded as limitations upon the scope of the invention, except as and to the extent that they are included in the accompanying claims.

What is claimed is:

1. 3,6-Bis(1H-1,2,3,4-tetrazol-5-ylamino)-1,2,4,5-tetrazine.

2. A salt of 3,6-Bis(1H-1,2,3,4-tetrazol-5-ylamino)-1,2,4,5-tetrazine selected from the group consisting of 3,6-Bis(1H-1,2,3,4-tetrazol-5-ylamino)-1,2,4,5-tetrazine2$NH_4^+$, 3,6-Bis(1H-1,2,3,4-tetrazol-5-ylamino)-1,2,4,5-tetrazine2$NH_2NH_3^+$, and 3,6-Bis(1H-1,2,3,4-tetrazol-5-ylamino)-1,2,4,5-tetrazine2$HONH_3^+$.

* * * * *